US010736382B2

(12) United States Patent
Hatfield et al.

(10) Patent No.: US 10,736,382 B2
(45) Date of Patent: Aug. 11, 2020

(54) PAIR OF ASYMMETRICAL FOOTWEAR ARTICLES

(71) Applicant: NIKE, Inc., Beaverton, OR (US)

(72) Inventors: Tobie D. Hatfield, Lake Oswego, OR (US); Xavier Smith, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 47 days.

(21) Appl. No.: 16/059,806

(22) Filed: Aug. 9, 2018

(65) Prior Publication Data

US 2019/0045885 A1 Feb. 14, 2019

Related U.S. Application Data

(60) Provisional application No. 62/543,791, filed on Aug. 10, 2017.

(51) Int. Cl.

| | |
|---|---|
| ***A43B 23/02*** | (2006.01) |
| ***A43B 3/00*** | (2006.01) |
| ***A43B 13/14*** | (2006.01) |
| ***A43C 1/00*** | (2006.01) |
| ***A43B 5/06*** | (2006.01) |
| ***A43C 15/16*** | (2006.01) |

(52) U.S. Cl.

CPC ..... *A43B 23/027* (2013.01); *A43B 3/0036* (2013.01); *A43B 13/14* (2013.01); *A43C 1/003* (2013.01); *A43B 5/06* (2013.01); *A43C 15/16* (2013.01)

(58) Field of Classification Search

CPC ... A43B 23/027; A43B 23/088; A43B 3/0036; A43B 3/0094; A43B 5/06; A43B 5/008; A43B 5/02; A43B 5/10; A43B 5/001; A43B 5/0411; A43B 13/14; A43C 1/003; A43C 15/16

USPC ..... 36/114, 115, 116, 129

See application file for complete search history.

(56) References Cited

U.S. PATENT DOCUMENTS 3,769,723 A * 11/1973 Masterson ..... A43B 5/02 36/128

4,149,324 A 4/1979 Lesser et al.

(Continued)

FOREIGN PATENT DOCUMENTS

DE 10000472 A1 * 7/2000 ..... A43B 3/0094

OTHER PUBLICATIONS

Warnett, Gary, "The 50 Greatest Running Shoes of All Time," Complex, complex.com. Aug. 30, 2011. http://www.complex.com/sneakers/2011/08/the-50-greatest-running-shoes-of-alltime/33.

(Continued)

*Primary Examiner* — Sharon M Prange
*Assistant Examiner* — Grace Huang

(57) ABSTRACT

A pair of shoes may be asymmetric between one another in various respects. For example, the left shoe may include a throat extending gradually towards a lateral side of the left shoe while the right shoe may include a throat extending gradually towards a medial side of the left shoe. In addition, the left shoe may include a heel counter constructed into a left-shoe heel portion that provides more support on the medial side than on the lateral side of the left shoe, while the right shoe may include a heel counter constructed into a right-shoe heel portion that provides more support on the lateral side than on the medial side of the right shoe.

18 Claims, 7 Drawing Sheets

(56) References Cited

U.S. PATENT DOCUMENTS

| | | | | |
|---|---|---|---|---|
| 4,335,529 | A | 6/1982 | Badalamenti | |
| 4,402,146 | A | 9/1983 | Parracho et al. | |
| 4,527,345 | A | 7/1985 | Lopez Lopez | |
| 4,854,055 | A * | 8/1989 | Sugiyama | A43B 5/00 36/127 |
| 4,885,851 | A | 12/1989 | Peterson | |
| 5,713,143 | A * | 2/1998 | Kendall | A43B 7/14 36/145 |
| 5,979,080 | A * | 11/1999 | Borsoi | A43C 1/00 24/712 |
| 6,430,847 | B2 | 8/2002 | Fusco et al. | |
| 6,618,960 | B2 * | 9/2003 | Brown | A43B 7/142 36/44 |
| 6,973,746 | B2 | 12/2005 | Auger et al. | |
| 7,543,397 | B2 | 6/2009 | Kilgore et al. | |
| 7,823,301 | B2 | 11/2010 | Belluto | |
| 8,302,329 | B2 * | 11/2012 | Hurd | A43B 23/08 36/88 |
| 8,356,429 | B2 | 1/2013 | Eder et al. | |
| 8,584,378 | B2 * | 11/2013 | Weidl | A43B 1/0009 36/45 |
| 8,631,590 | B2 | 1/2014 | Droege et al. | |
| 8,881,429 | B2 | 11/2014 | Schwartz | |
| 9,918,514 | B2 * | 3/2018 | Droege | A43B 5/02 |
| 2002/0020082 | A1 | 2/2002 | James | |
| 2010/0229426 | A1 * | 9/2010 | Brown | A43B 1/04 36/129 |
| 2013/0074374 | A1 * | 3/2013 | Droege | A43B 7/24 36/133 |
| 2013/0104422 | A1 | 5/2013 | Hatfield et al. | |
| 2014/0202044 | A1 * | 7/2014 | Adami | A43B 7/141 36/34 R |
| 2014/0223769 | A1 * | 8/2014 | Dekovic | A43B 5/02 36/83 |
| 2014/0352170 | A1 * | 12/2014 | Heathcote | A43B 5/12 36/8.3 |
| 2015/0128451 | A1 | 5/2015 | Baker et al. | |
| 2015/0173458 | A1 * | 6/2015 | Ikenaka | A43B 1/04 36/45 |
| 2015/0257476 | A1 | 9/2015 | Panian et al. | |
| 2016/0015120 | A1 | 1/2016 | Denison et al. | |

OTHER PUBLICATIONS

"New Balance 860v6," NB, newbalance.com, accessed: 2015. http://www.newbalance.com/pd/new-balance-860v6/M860-V6.html#color=BlueAshes_with_White.

* cited by examiner

PAIR OF ASYMMETRICAL FOOTWEAR ARTICLES

CROSS-REFERENCE TO RELATED APPLICATION

This application, claims the benefit of priority of U.S. Provisional Application No. 62/543,791, entitled "Pair of Asymmetrical Footwear Articles," and filed Aug. 10, 2017. The entirety of the aforementioned application is incorporated by reference herein.

TECHNICAL FIELD

This disclosure is related to a pair of footwear articles having asymmetric features between the pair.

BACKGROUND

In footwear used for running, exercising, and other physical activity, shoes will commonly include a sole and an upper. The sole may include various elements that provide functions, such as protection from a ground surface, traction, impact attenuation, cushion, responsiveness, and the like. The upper wraps around at least a portion of a foot in order to secure the foot to the sole, and may also include various elements for providing warmth, weather resistance (e.g., water, wind, etc.), breathability, support, and the like. Pairs of shoes typically include a left shoe and a right shoe. Each of the left shoe and the right shoe will have a plurality of reciprocal features.

BRIEF SUMMARY

At a high level, the present application is generally directed to a pair of shoes having asymmetric features between a left shoe and a right shoe. For instance, the structure of the upper or the sole of the left shoe may be different from the structure of the upper or the sole of right shoe. A high-level overview of various aspects of the disclosure is provided here to introduce a selection of concepts that are further described in the detailed-description section below. This summary is not intended to identify key features, or essential features, of the claimed subject matter, nor is it intended to be used as an aid in isolation to determine the scope of the claimed subject matter.

BRIEF DESCRIPTION OF THE DRAWINGS

The subject matter of this disclosure is described in detail herein with reference to the attached drawing figures, which are incorporated herein by reference, wherein.

DETAILED DESCRIPTION

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are equivalent to the ones described in this disclosure. In other words, the intended scope of the claims, and the other subject matter described in this specification, includes equivalent features, aspects, materials, methods of construction, and other aspects not expressly described or depicted in this application in the interests of concision, but which would be understood by an ordinarily skilled artisan in the relevant art in light of the full disclosure provided herein as being included within the inventive scope. It will be understood that certain features and subcombinations are of utility and may be employed without reference to other features and subcombinations. This is contemplated by and is within the scope of the claims.

At a high level, the present application is generally directed to a pair of shoes having asymmetric features between a left shoe and a right shoe. In other words, the structure of the upper or the sole of the left shoe is different from the structure of the upper or the sole of right shoe. This is in contrast with some pairs of shoes in which the upper and sole of the right shoe are substantially the same as the upper and sole of the left shoe, albeit mirror images of one another. So in this sense, and in accordance with an aspect of this disclosure, in a pair of shoes the left shoe is not a mirror image of the right shoe.

The variance in respective structures of each shoe may be configured to affect one or more functions of the footwear articles, such as the support or fit provided by the shoe when in use. In some aspects, a left-shoe throat may extend gradually towards a lateral side of the left shoe, while a right-shoe throat may extend gradually towards a medial side of the right shoe. In other aspects, a heel counter constructed in a left shoe may provide more support on the medial side of a left-shoe heel portion than on the lateral side of the left-shoe heel portion (e.g., by being larger on the medial side than on the lateral side), while a heel counter constructed in a right shoe may provide more support on the lateral side of a right-shoe heel portion than on the medial side of the right-shoe heel portion. Among other functions, these features may provide an amount of support on the medial side of the left shoe and an amount of support on the lateral side of the right shoe, the support being conducive to at least some physical activity, such as when a wearer cuts on a court or field or runs on a curved surface.

Figure 1:
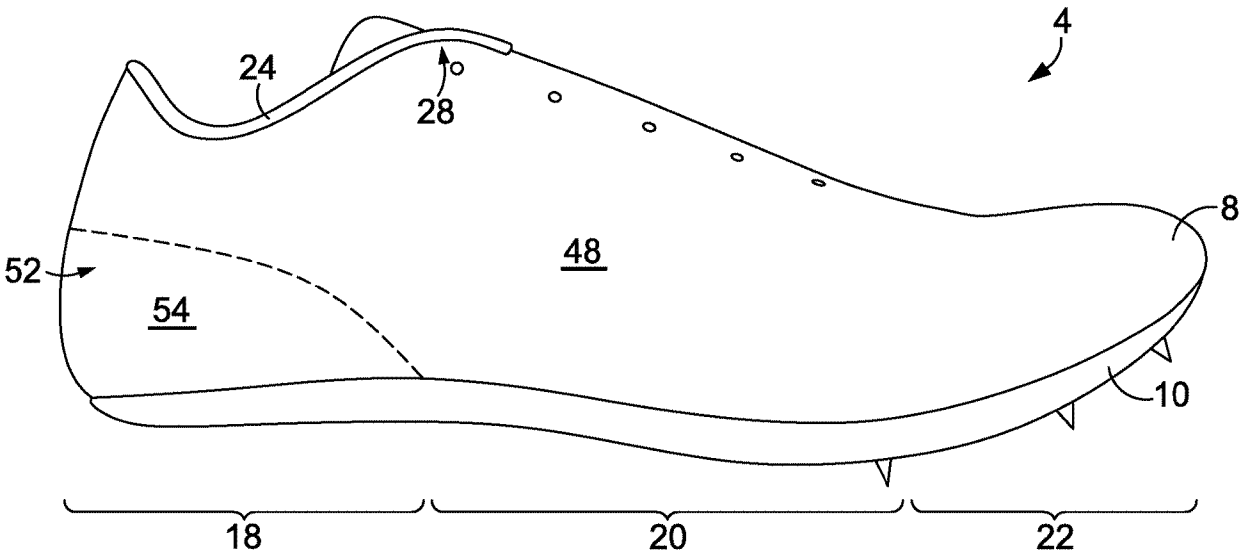
FIG. 1 depicts a side view of a shoe in accordance with an aspect hereof.
Figure 2:
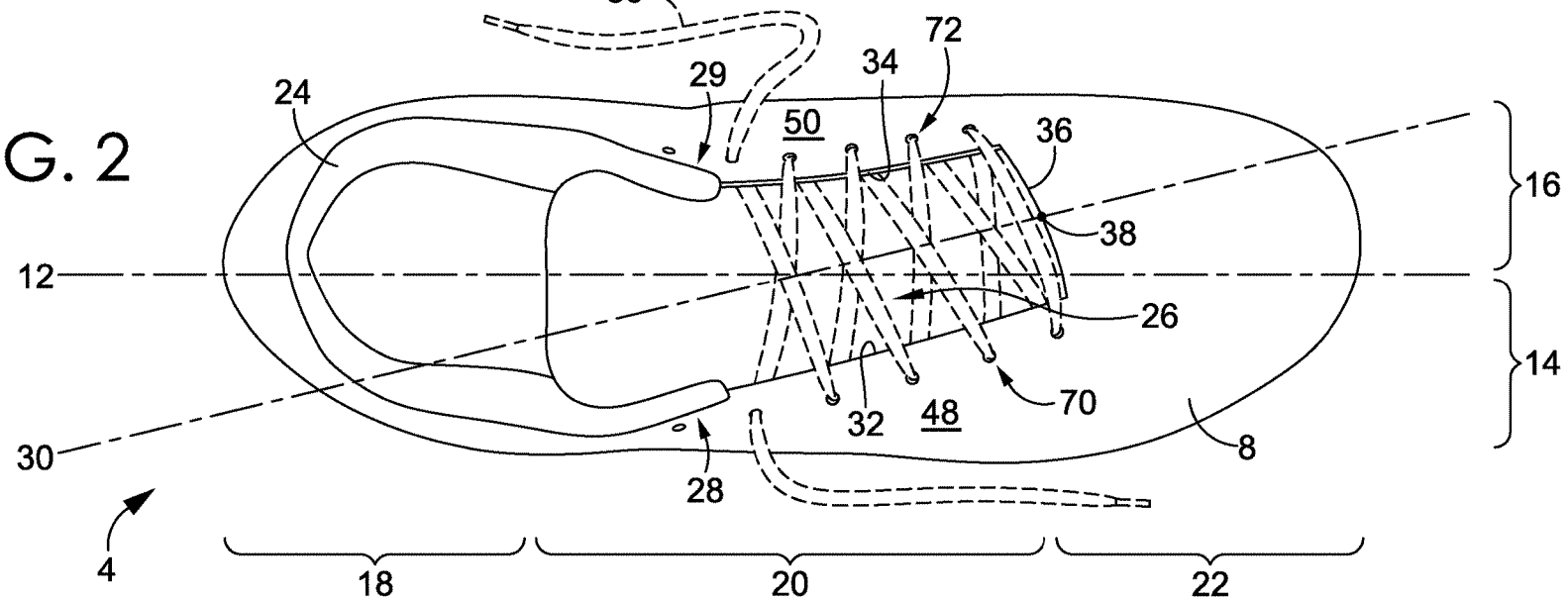
FIG. 2 depicts a top view of the shoe of FIG. 1 in accordance with an aspect hereof.

Referring now to FIGS. 1 and 2, an exemplary article of footwear 4 is illustrated to help explain some footwear structures, at least some of which may have a different configuration as between a left shoe and a right shoe. The footwear article 4 includes a sole 10 and an upper 8. The upper 8 and the sole 10 generally form a foot-receiving space that encloses at least part of a foot when the footwear article 4 is worn or donned. The foot-receiving space is accessible by inserting a foot through an opening formed by an ankle collar 24. The upper 8 generally functions to secure a wearer's foot to the sole 10, and in some instances, is adjustable to loosen or tighten a fit of the footwear article 4. The sole 8 generally functions to protect the bottom of a wearer's foot from a ground surface and may also provide traction, cushioning, responsiveness, and the like.

While the examples of shoe uppers (e.g., upper 8) and shoe bottom units (e.g., sole 10) are presented in a simplified fashion for exemplary purposes herein, in practice a shoe upper may comprise a large number of individual parts, often formed from different types of materials. Alternatively, a shoe upper 8 may be primarily formed from a single manufacturing technique, such as weaving or knitting, to concurrently and integrally form two or more portions of the shoe upper. The components of a shoe upper may be joined together using a variety of adhesives, stitches, and other types of joining/bonding components.

A sole 10 often includes an assembly of multiple components. For example, a sole 10 may comprise an outsole made of a relatively hard and durable material, such as rubber, that contacts the ground, floor, or other surface. A sole 10 may further comprise a midsole formed from a material that provides cushioning and absorbs/attenuates force during normal wear and/or athletic training or performance. Examples of materials often used in midsoles are, for example, ethylene vinyl acetate (EVA), thermoplastic polyurethane (TPU), thermoplastic elastomer (e.g., polyether block amide), and the like. Shoe soles may further have additional components, such as additional cushioning components (such as springs, air bags, and the like), functional components (such as motion control elements to address pronation or supination), protective elements (such as resilient plates to prevent damage to the foot from hazards on the floor or ground), and the like. Although the footwear article 4 depicted in the illustrative figures is depicted to include a running shoe or a track spike, in other aspects of this disclosure the features and elements described herein, may be incorporated into other types of footwear.

When describing various aspects of the footwear article 4, relative terms may be used to aid in understanding relative positions. For instance, the footwear article 4 may be divided into three general regions: a forefoot region 22, a mid-foot region 20, and a heel region 18. In addition, the footwear article 4 also includes a lateral side 14 (FIG. 2), a medial side 16 (FIG. 2), a superior portion, and an inferior portion. The forefoot region 22 generally includes portions of the footwear article 4 corresponding with the toes and the joints connecting the metatarsals with the phalanges. The mid-foot region 20 generally includes portions of footwear article 4 corresponding with the arch area of the foot, and the heel region 18 corresponds with rear portions of the foot, including the calcaneus bone. The lateral side and the medial side extend through each of regions 18, 20, and 22 and correspond with opposite sides of footwear article 4. More particularly, the lateral side corresponds with an outside area of the foot (i.e., the surface that faces away from the other foot), and the medial side corresponds with an inside area of the foot (i.e., the surface that faces toward the other foot). For illustrative purposes, FIG. 2 depicts a midline reference plane 12 that extends from the forefoot region 22 to the heel region 18 and that generally bisects the footwear article 4 into the lateral side 14 and the medial side 12. Further, the superior portion and the inferior portion also extend through each of the regions 16, 18, and 20. The superior portion generally corresponds with a top portion that is oriented towards a person's head when the person's feet are positioned flat on the ground and the person is standing upright, whereas the inferior portion generally corresponds with a bottom portion oriented towards the bottom of a person's foot. These regions 18, 20, and 22, medial/lateral sides, and superior/inferior portions are not intended to demarcate precise areas of footwear article 4. They are intended to represent general areas of footwear article 4 to aid in understanding the various descriptions provided in this Specification. In addition, the regions, sides, and portions are provided for explanatory and illustrative purposes and are not meant to require a human being for interpretive purposes.

FIGS. 1 and 2 depict some additional elements as well. For example, the upper 8 includes a throat 26 that extends from the collar 24 towards the forefoot portion 22. More specifically, the upper 8 includes a first transition 28 and a second transition 29 that transition from the collar 24 to the throat 26. In addition, the throat 26 includes at least one edge defining a perimeter of the throat 26. In the illustrated aspect, the throat 26 includes a throat lateral edge 32, a throat medial edge 34, and a throat base 36.

In some aspects, the throat 26 may have a throat midline reference plane 30 that generally bisects the throat 26. For example, the throat midline reference plane 30 passes through a midpoint 38 of the throat base 36, as well as a midpoint spaced evenly between the transitions 28 and 29. In the illustrative footwear article 4, the throat midline reference plane 30 is angled relative to the midline reference plane 12. And in other aspects, the throat midline reference plane 30 may be coplanar with the midline reference plane 12 or parallel with the midline reference plane 12 (but not necessarily coplanar).

The throat 26 generally divides the upper 8 between a lateral-side portion 48 and a medial-side portion 50. In some aspects, the lateral-side portion 48 and the medial-side portion 50 may be substantially the same size. In other aspects, the lateral-side portion 48 comprises at least the midfoot portion 20 of the upper 8 between the throat lateral edge 32 and a bite line of the footwear article 4. In addition, the medial-side portion 50 may comprise at least the midfoot portion 20 of the upper 8 between the throat medial edge 34 and the bite line of the footwear article 4.

The illustrated upper 8 also includes eyelets positioned along the throat lateral edge 32 and the throat medial edge 34. For example, a series of eyelets (e.g., eyelet 70) are positioned along the throat lateral edge 32, and a series of eyelets (e.g., eyelet 72) are positioned along the throat medial edge 34. Each eyelet includes an aperture configured to slidably receive a lacing element 80 (e.g., shoe lace, cable, cord, braid, etc.), which is sinuously threaded through consecutively positioned eyelets, back and forth between the throat edges. As such, the lacing element 80 is configured to tighten a fit of the upper 8 by drawing the throat edges towards one another and to loosen the fit of the upper 8 by releasing a tension applied to the throat edges. For example, when the footwear article 4 is being donned and a tension is applied to the lacing element 80, the lacing element 80 draws the throat edges towards one another, and in turn draws the lateral-side portion 48 and medial-side portion 50 of the upper 8 against the foot of the wearer to tighten a fit and provide support.

Although the throat edges are illustrated as relatively straight, in other instances, the throat edges may be scalloped, or include some other configuration. In these instances, the eyelets may follow the contour of the throat edge, or alternatively, may be aligned in a relatively straight line extending along the throat edge. Regardless, the series of eyelets may still be considered aligned with the throat edge where an eyelet near the throat base 36 and an opposing eyelet near the transition 28 (or 29) are spaced a similar distance from the respective part of the throat edge. Furthermore, the eyelets are illustratively depicted as holes or apertures that extend through the upper 8. But in other aspects, the eyelets may have a different configuration, such as a cord loop that is anchored to the upper 8, to the sole 10, or to the upper 8 and the sole 10.

The footwear article 4 may also include a heel counter 52 constructed into the heel portion 18 of the upper 8, the sole 10, or both the upper 8 and the sole 10. The heel counter 52 may extend from the lateral side 14 of the footwear article 4 to the medial side 16 of the footwear article 4. For example, the heel counter 52 may wrap around a heel of the footwear article 4 and extend towards the forefoot portion 22. Hence, in aspects, the heel counter 52 may include a lateral heel-counter portion 54 and a medial heel counter portion 56 (not shown in FIGS. 1 and 2). The lateral heel-counter portion 54 may provide support on the lateral side 14 of the footwear article 4, while the medial heel-counter portion 56 may provide support on the medial side 16 of the footwear article 4.

Figure 3:
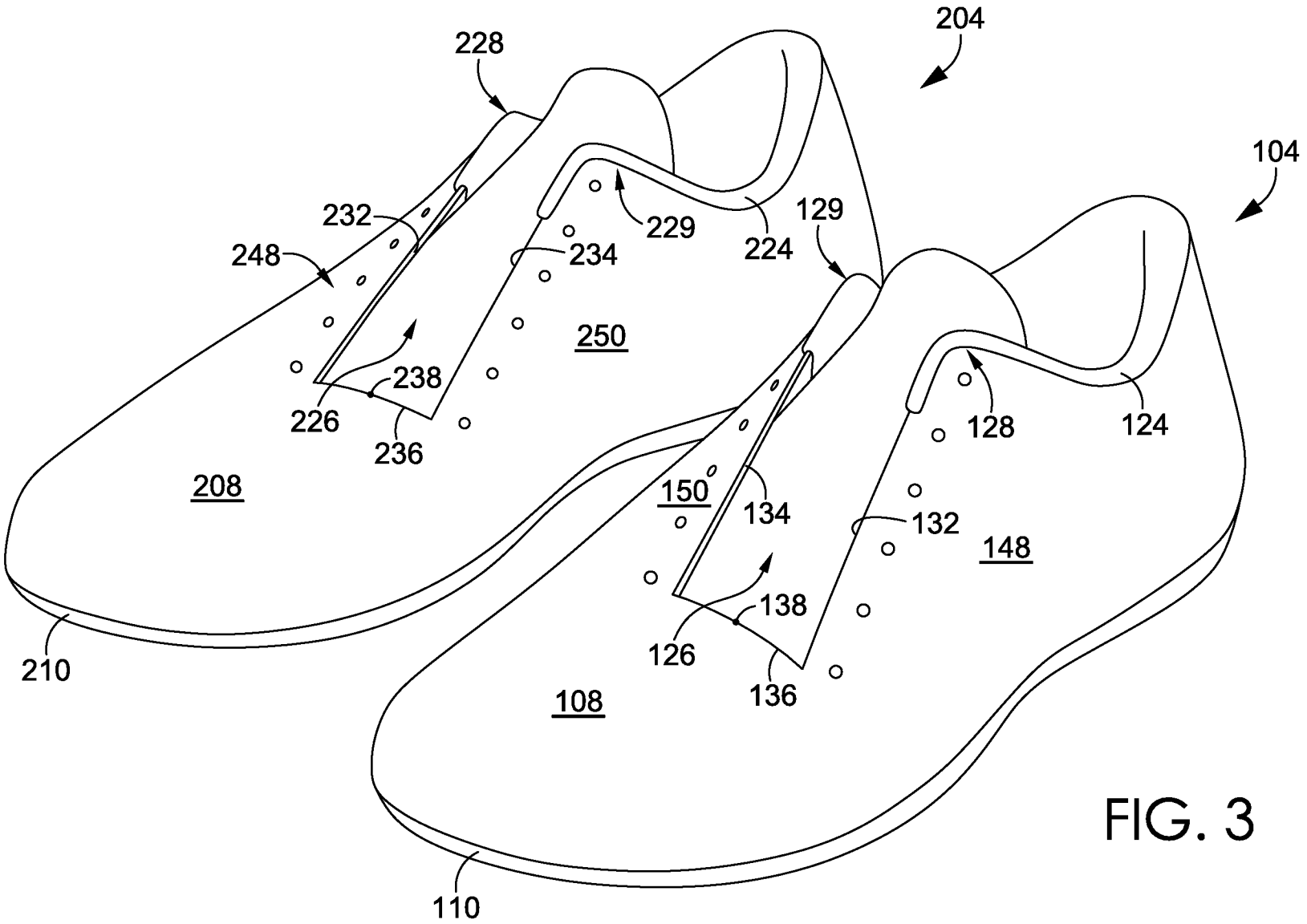
FIG. 3 depicts an isometric view of a pair of shoes in accordance with an aspect hereof.
Figure 4:
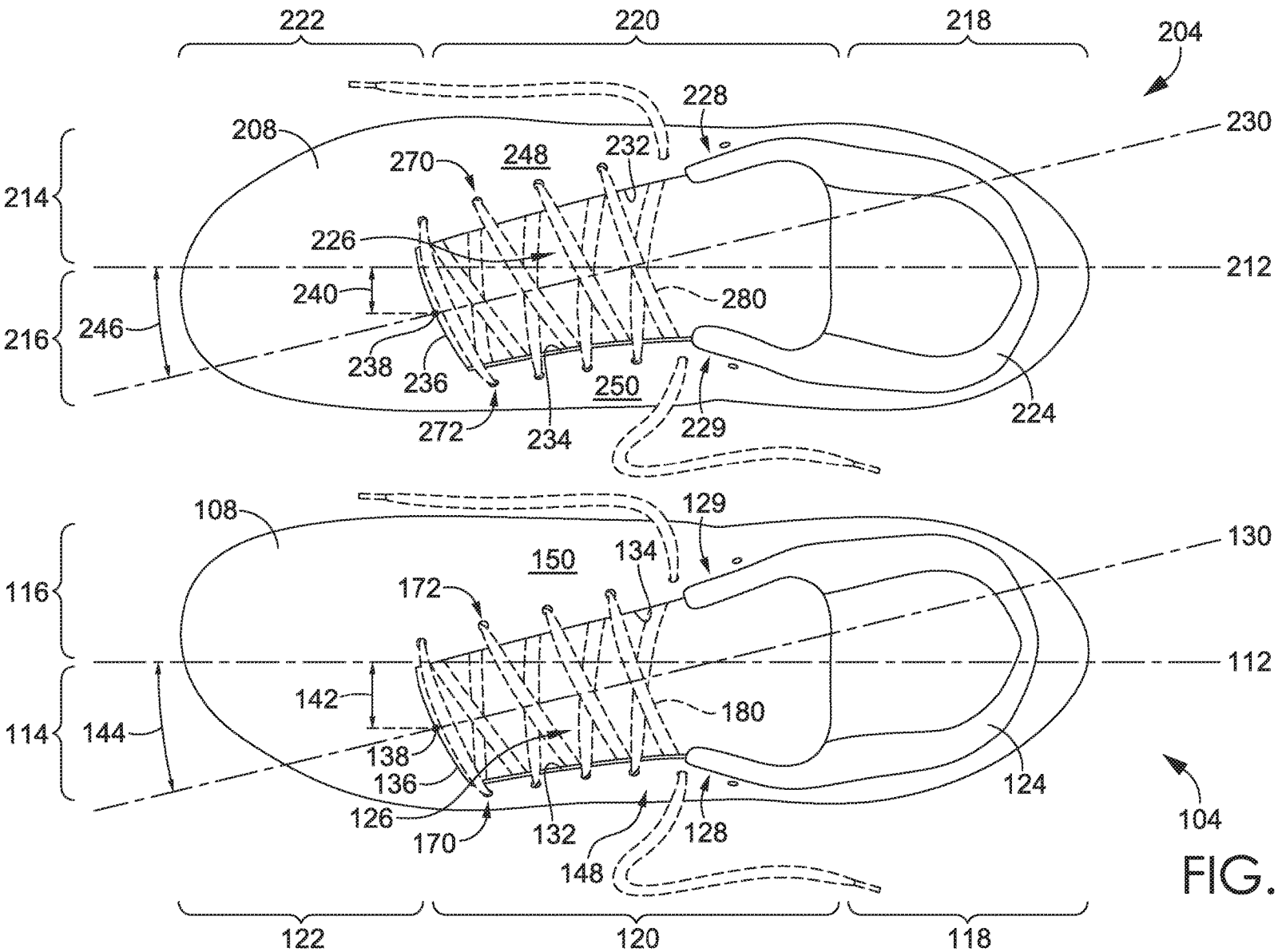
FIG. 4 depicts a top view of the pair of shoes of FIG. 3 in accordance with an aspect hereof.
Figure 5:
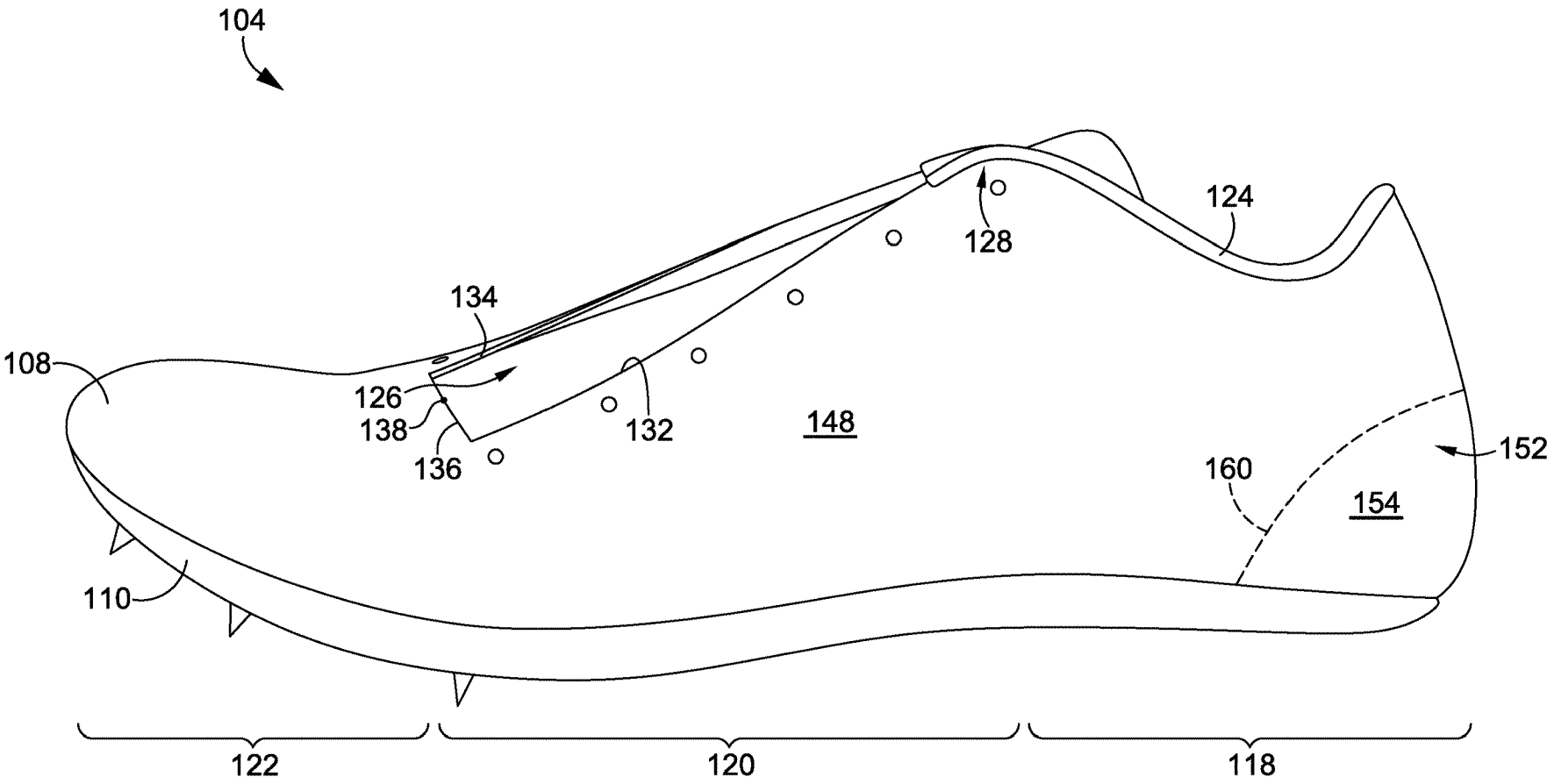
FIG. 5 depicts a lateral side of a left shoe in accordance with an aspect hereof.
Figure 6:
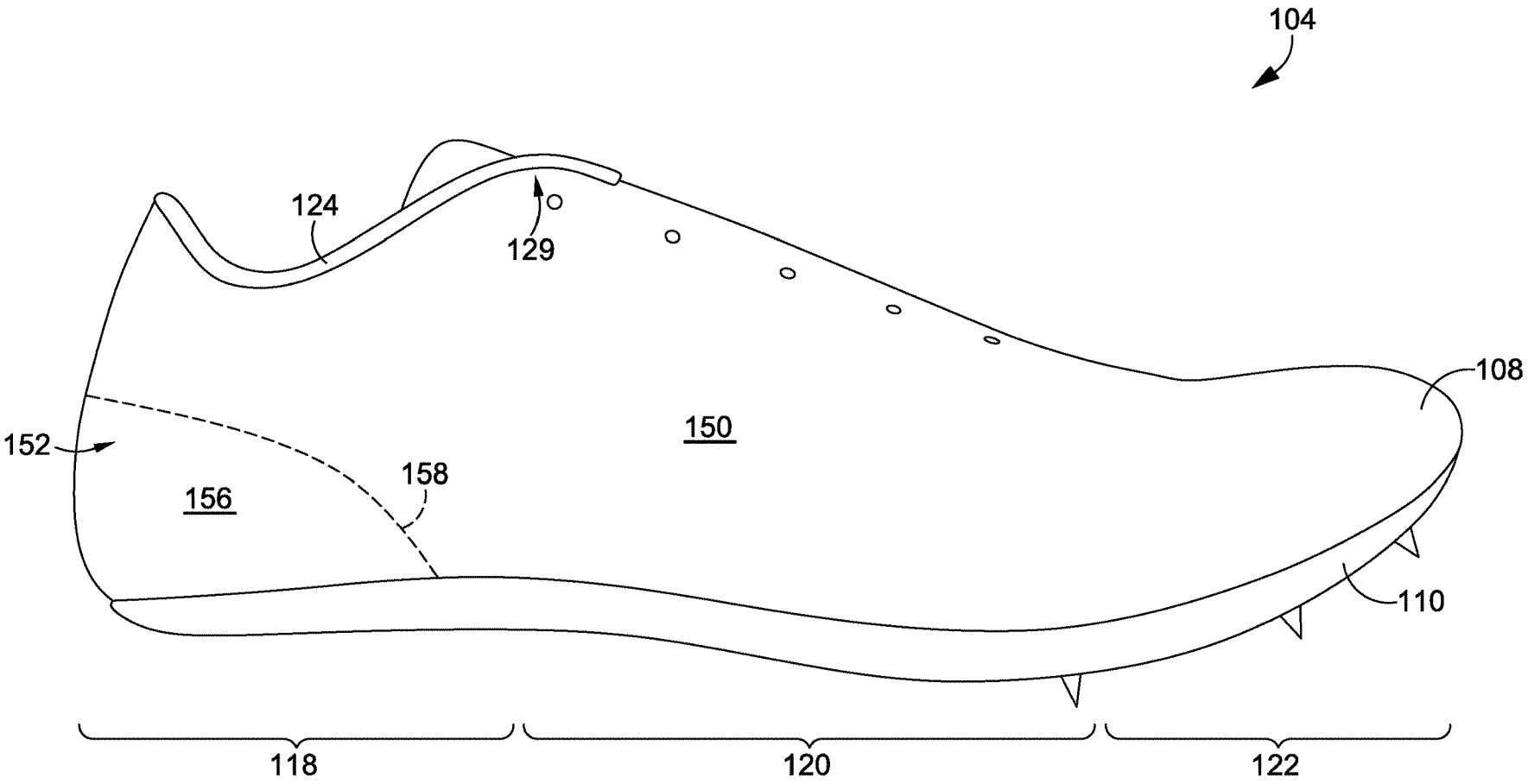
FIG. 6 depicts a medial side of the left shoe of FIG. 5 in accordance with an aspect hereof.
Figure 7:
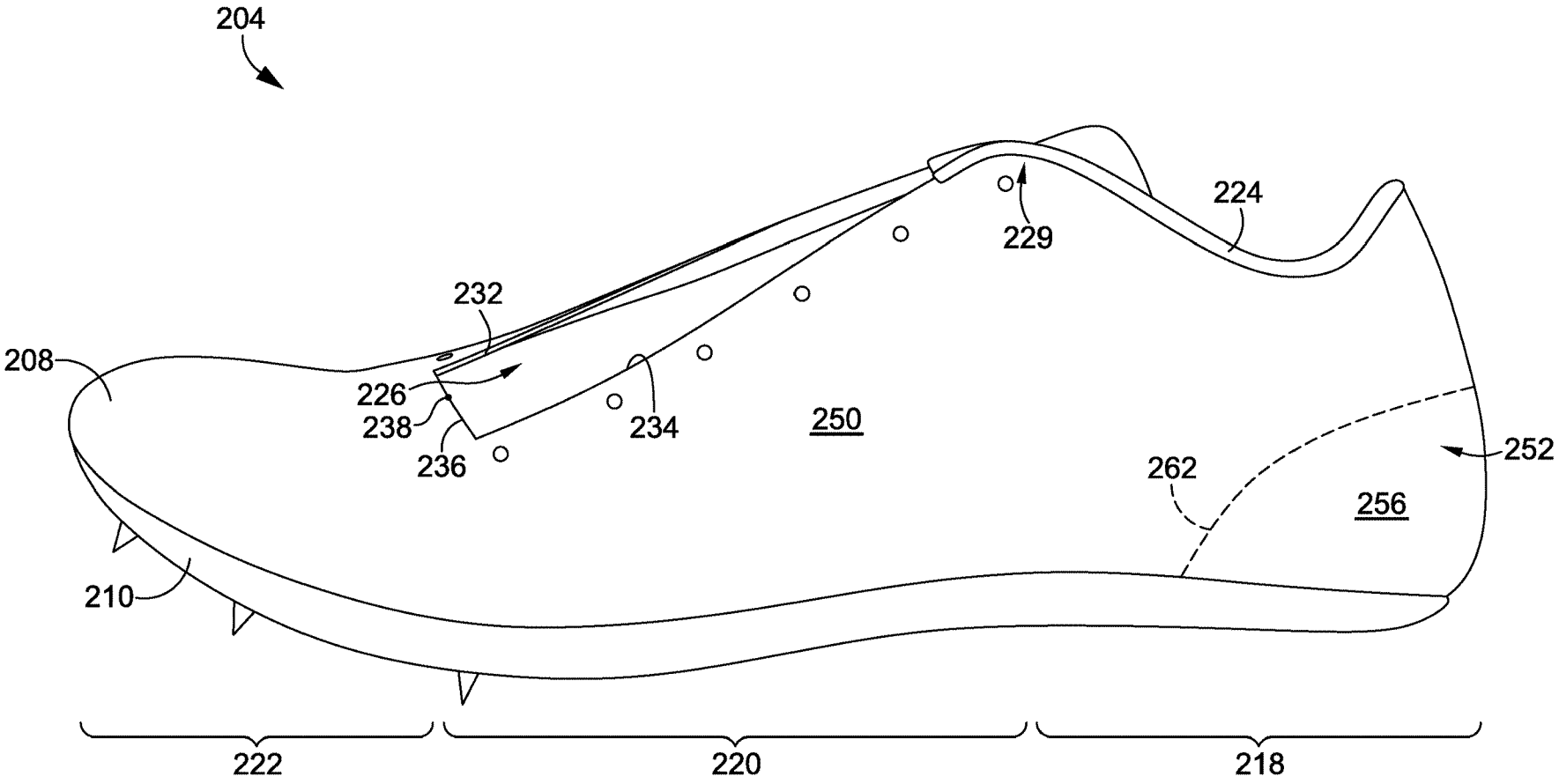
FIG. 7 depicts a medial side of a right shoe in accordance with an aspect hereof.
Figure 8:
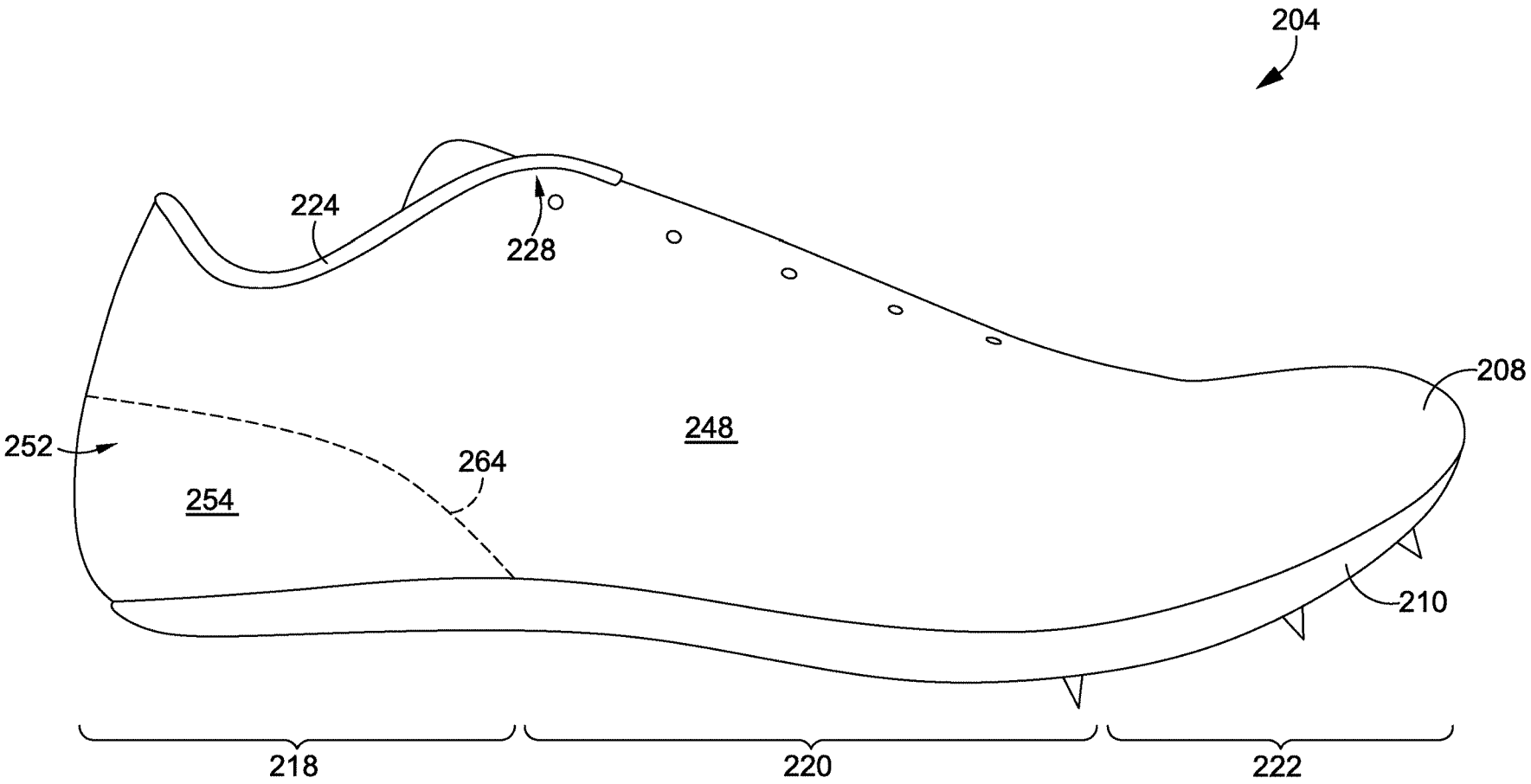
FIG. 8 depicts a lateral side of the right shoe of FIG. 7 in accordance with an aspect hereof.

Having described some elements of a footwear article 4 that may be asymmetric as between a right shoe and a left shoe, reference is now made to FIGS. 3 and 4 to describe a pair of shoes having asymmetric features between a left shoe 104 and a right shoe 204. For example, the left-shoe throat 126 may disproportionately divide the left shoe upper 108 into a medial side portion 150 that is larger than a lateral side portion 148 and the right-shoe throat 226 may disproportionately divide the right-shoe upper 208 into a lateral side portion 248 that is larger than a medial side portion 250.

In aspects, the throat bases may be offset from the respective midline reference planes in opposite directions (e.g., one towards a medial side of one shoe and one towards a lateral side of the other shoe). For example, the left-shoe throat base 136 may be offset from the left-shoe midline reference plane 112 towards the lateral side 114 of the left shoe 104 and the right-shoe throat base 236 may be offset from the right-shoe midline reference plane 212 towards the medial side 216 of the right shoe 204. In some aspects, the midpoint 238 of the right-shoe throat base 236 may be offset a first amount 240 from the right-shoe midline reference plane 212 and the midpoint 138 of the left-shoe throat base 136 may be offset a second amount 142 from the left-shoe midline reference plane 112. The first amount 240 of offset may be less than, equal to, or greater than the second amount 142 of offset.

In other aspects, the left-shoe throat midline reference plane 130 may intersect the left-shoe midline reference plane 112 at a first angle 144 and the right-shoe throat midline reference plane 230 may intersect the right-shoe midline reference plane 212 at a second angle 246. The first angle 144 may be less than, equal to, or greater than the second angle 246.

In some aspects, at least some portions of the throat of each shoe may be positioned on one side of the respective midline reference plane, and other portions may be positioned on an opposite side of the respective midline reference plane, as shown in FIG. 4. For example, a second transition 129 of the left shoe 104 between a throat medial edge 134 and a left shoe collar 124 may be positioned on the medial side 116 of the midline reference plane 112. As such, the left-shoe throat 126 may extend from the left-shoe collar 124 towards the left-shoe forefoot portion 122 and gradually towards the left-shoe lateral side 114, such that at least a portion of the left-shoe throat 126 (e.g., a first transition 128 of the left shoe 104 between a throat lateral edge 132 and the left-shoe collar 124) is positioned on the lateral side 114 of the midline reference plane 112. Although the figures depict an exemplary aspect in which the throat is positioned on both sides of the midline reference plane 112, in other aspects, a throat of each shoe may be positioned entirely on one side of a respective midline reference plane. For example, a second transition 129 of the left shoe 104 between a throat medial edge 134 and a left shoe collar 124 may be positioned on the lateral side 116 of the midline reference plane 112, and the left-shoe throat 126 may extend from the left-shoe collar 124 towards the left-shoe forefoot portion 122 and gradually towards the left-shoe lateral side 114 Likewise, both transitions 228 and 229 might be positioned on the medial side of the right shoe.

As depicted in FIG. 4, the eyelets of each shoe 104 and 204 are generally aligned with respective throat edges. For example, the left shoe 104 includes a series of eyelets (e.g., eyelet 170) that are positioned along the throat lateral edge 132 and a series of eyelets (e.g., eyelet 172) that are positioned along the throat medial edge 134. Similarly, the right shoe 204 includes a series of eyelets (e.g., eyelet 270) that are positioned along the throat lateral edge 232 and a series of eyelets (e.g., eyelet 272) that are positioned along the throat medial edge 234. As previously explained, the lacing elements 180 and 280 are configured to tighten a fit of the respective upper by drawing the throat edges towards one another and to loosen the fit of the upper by releasing a tension applied to the throat edges. As such, when a tension is applied to the lacing element, the lacing element draws the throat edges towards one another, and in turn draws the lateral side upper and medial side upper against the foot of the wearer.

In an aspect of the present disclosure, the orientation of the throat edges relative to a shoe midline (explained above in this disclosure), also applies to the eyelets. That is, where a series of eyelets are aligned in a manner that generally follows a respective throat edge, the series of eyelets will also be oriented at an angle relative to the midline reference plane. As a result, the amount of upper on which a lace element is pulling (when tension is applied to the lace element) increases or decreases depending on the orientation of the series of eyelets. For instance, the series of eyelets positioned along the medial throat edge 134 of the left shoe 104 would apply tension to the medial-side portion 150, and the series of eyelets positioned along the lateral throat edge 132 would apply tension to the lateral-side portion 148 of the upper 108. In this instance, the medial-side portion 150 is larger than the lateral-side portion 148. As a result, when the lace element 180 is tensioned to pull on the larger medial-side portion 150 and the smaller lateral-side portion 148, a larger amount of support may be provided against the medial side of a wearer's left foot, as compared to an amount of support provided against the lateral side of the wearer's left foot. Similar to the left shoe 104, the series of eyelets positioned along the lateral throat edge 232 of the right shoe 204 would apply tension to the lateral-side portion 248, and the series of eyelets positioned along the medial throat edge 234 would apply tension to the medial-side portion 250. And in an asymmetric manner (as compared with the left shoe 104), the illustrated upper 208 of the right shoe 204 has a larger lateral-side portion 248 than medial-side portion 250. As a result, when the lace element 280 is tensioned to pull on the larger lateral-side portion 248 and the smaller medial-side portion 250, a larger amount of support may be provided against the lateral side of a wearer's right foot, as compared to an amount of support provided against the medial side of the wearer's right foot.

In a further aspect, the varied support provided by each of the left shoe 104 and the right shoe 204 is conducive to participating in particular activities. For example, in some sporting events, participants run, sprint, skate, or otherwise race, on a circular or ovular track. In instances in which the participants race in the counterclockwise direction, the turns or curves are to the left, and the participant's right foot is the outside foot. In these instances, particularly when a participant is turning, a larger amount of force is applied to the lateral side 214 of the right shoe 204 and the medial side 116 of the left shoe 104. As such, the pair of shoes depicted in FIG. 4 is configured to apply a greater amount of support on the lateral side 214 of the right shoe 204 and the medial side 116 of the left shoe 104, as explained in the previous paragraph.

Referring now to FIGS. 5-8, lateral side views and medial side views of the left shoe 104 and a right shoe 204 are depicted. These views further depict additional asymmetrical features between the pair of shoes that are configured to provide varied amounts of support between the shoes.

The left shoe 104 may include a left-shoe heel counter 152 having a lateral heel counter portion 154 and a medial heel counter portion 156. The lateral heel counter portion 154 may be positioned on the lateral side 114 (as seen in FIG. 4) of the midline reference plane 112 (as seen in FIG. 4) and the medial heel counter portion 156 may be positioned on the medial side 116 (as seen in FIG. 4) of the midline reference plane 112, in accordance with some aspects. The right shoe 204 may include a right-shoe heel counter 252 having a lateral heel counter portion 254 and a medial heel counter portion 256. The lateral heel counter portion 254 may be positioned on the lateral side 214 (as seen in FIG. 4) of the midline reference plane 212 (as seen in FIG. 4) and the medial heel counter portion 256 may be positioned on the medial side 216 (as seen in FIG. 4) of the midline reference plane 212, in accordance with some aspects.

The lateral heel counter portion 154 may provide a first amount of support on the lateral side 114 of the left-shoe upper 108. The medial heel counter portion 156 may provide a second amount of support on the medial side 116 of the left-shoe upper 108. In some aspects, the second amount of support may be greater than the first amount of support. The lateral heel counter portion 254 may provide a third amount of support on the lateral side 214 of the right-shoe upper 208. The medial heel counter portion 256 may provide a fourth amount of support on the medial side 216 of the right-shoe upper 208. In some aspects, the third amount of support may be greater than the fourth amount of support. In other aspects, the second amount of support may be less than, equal to, or greater than the third amount of support. In still other aspects, the first amount of support may be less than, equal to, or greater than the fourth amount of support. In yet other aspects, the second amount of support may be equal to the fourth amount of support.

In some aspects, the medial heel counter portion 156 of the left shoe 104 is larger than the lateral heel counter portion 154 of the left shoe 104 while the lateral heel counter portion 254 of the right shoe 204 is larger than the medial heel counter portion 256 of the right shoe 204.

The left-shoe heel counter 152 may extend from the heel portion 118 towards the forefoot portion 122 on both the lateral side 114 and the medial side 116 and the right-shoe heel counter 252 may extend from the heel portion 218 towards the forefoot portion 222 on both the lateral side 214 and the medial side 216. For example, in some aspects, the medial heel counter portion 156 may include a first leading edge 158 oriented towards the forefoot portion 122 and the lateral heel counter portion 154 may include a second leading edge 160 oriented towards the forefoot portion 122. Likewise, in other aspects, the medial heel counter portion 256 may include a third leading edge 262 oriented towards the forefoot portion 222 and the lateral heel counter portion 254 may include a fourth leading edge 264 oriented towards the forefoot portion 222.

The first leading edge 158 may be closer to the forefoot portion 122 than the second leading edge 160, in accordance with some aspects. This may result in a larger area of support on the medial side 116 than on the lateral side 114 of the left shoe 104. The fourth leading edge 264 may be closer to the forefoot portion 222 than the third leading edge 262, in accordance with other aspects. This may result in a larger area of support on the lateral side 214 than on the medial side 216 of the right shoe 204. In still other aspects, a distance between the first leading edge 158 and the forefoot portion 122 on the left shoe 104 may be less than, equal to, or greater than a distance between the fourth leading edge 264 and the forefoot portion 222 on the right shoe 204. In yet other aspects, a distance between the second leading edge 160 and the forefoot portion 122 on the left shoe 104 may be less than, equal to, or greater than a distance between the third leading edge 262 and the forefoot portion 222 on the right shoe 204. This may result in a greater amount of support being provided to the right shoe 204 than the left shoe 104, which may be important when the right shoe 204 is the outside shoe during a turn.

In some aspects, the medial heel counter portion 156 of the left shoe 104 may be thicker than the lateral heel-counter portion 154 of the left shoe 104 while the lateral heel counter portion 254 of the right shoe 204 may be thicker than the medial heel-counter portion 256 of the right shoe 204. In other aspects, the medial heel counter portion 156 of the left shoe 104 may be less flexible than the lateral heel-counter portion 154 of the left shoe 104 while the lateral heel counter portion 254 of the right shoe 204 may be less flexible than the medial heel-counter portion 256 of the right shoe 204.

As discussed above, the varied support provided by each of the left shoe 104 and the right shoe 204 is conducive to participating in particular activities. As in the above example, in some sporting events, participants run, sprint, skate, or otherwise race, on a circular or ovular track. In instances in which the participants race in the counterclockwise direction, the turns or curves are to the left, and the participant's right foot is the outside foot. In these instances, particularly when a participant is turning, a larger amount of force is applied to the lateral side 214 of the right shoe 204 and the medial side 116 of the left shoe 104. As such, the right-shoe heel counter 252 and the left-shoe heel counter 152 depicted in FIGS. 5-8 are configured to apply a greater amount of support on the lateral side 214 of the right shoe 204 and the medial side 116 of the left shoe 104, respectively. In some aspects, the right-shoe heel counter 252 may provide a greater amount of support to the right shoe 204 than the left-shoe heel counter 152 provides to the left shoe 104. This may be of particular consequence when a participant is turning in the counterclockwise direction as the right shoe 204 will be the outside shoe to which a larger amount of force is applied during the turn. In addition to providing varied support between the left shoe 104 and the right shoe 204, the left-shoe heel counter 152 and the right-shoe heel counter 252 reduce the overall weight of the respective shoes. By having a lateral heel counter portion 154 on the left shoe 104 and a medial heel counter portion 256 on the right shoe 204 that are each smaller than the corresponding medial heel counter portion 156 on the left shoe 104 and lateral heel counter portion 254 on the right shoe 204, the overall weight of each shoe may be decreased.

Some aspects of this disclosure have been described with respect to the illustrative examples provided by FIGS. 1-8. Additional aspects of the disclosure will now be described that may related subject matter included in one or more claims of this application, or one or more related applications, but the claims are not limited to only the subject matter described in the below portions of this description. These additional aspects may include features illustrated by FIGS. 1-8, features not illustrated by FIGS. 1-8, and any combination thereof. When describing these additional aspects, reference may or may not be made to elements depicted by FIGS. 1-8.

One aspect disclosed herein is directed to a pair of shoes having a left shoe and a right. The left shoe may have a left-shoe upper with a left-shoe collar, a left-shoe forefoot portion, and a left-shoe throat extending from the left-shoe collar towards the left-shoe forefoot portion. The left-shoe throat may disproportionately divide the left-shoe upper into a medial-side portion that is larger than a lateral-side portion. The right shoe may have a right-shoe upper with a right-shoe collar, a right-shoe forefoot portion, and a right-shoe throat extending from the right-shoe collar towards the right-shoe forefoot portion. The right-shoe throat may disproportionately divide the right-shoe upper into a lateral-side portion that is larger than a medial-side portion.

The left-shoe throat may include a left-shoe throat base positioned on an end of the left-shoe throat opposite the left-shoe collar. The left-shoe throat base may be offset from a left-shoe midline reference plane towards a lateral side of the left shoe. The right-shoe throat may include a right-shoe throat base positioned on an end of the right-shoe throat opposite the right-shoe collar. The right-shoe throat base may be offset from a right-shoe midline reference plane towards a medial side of the right shoe. The right-shoe throat base may be offset by a first amount and the left-shoe throat base may offset by a second amount. The first amount is greater than the second amount, in some aspects.

The left shoe may further comprise a left-shoe heel counter having a lateral heel-counter portion and medial heel-counter portion. The medial heel-counter portion of the left-shoe upper may be larger than the lateral heel-counter portion of the left-shoe upper. The right shoe may further comprise a right-shoe heel counter having a lateral heel-counter portion and a medial heel-counter portion. The lateral heel-counter portion of the right-shoe upper may be larger than the medial heel-counter portion of the right-shoe upper.

Another aspect disclosed herein is directed to a pair of shoes having a left shoe and a right shoe. The left shoe may have a left-shoe upper, which includes a lateral side and a medial side. The left-shoe upper may include a left-shoe collar, a left-shoe forefoot portion, and a left-shoe throat extending from the left-shoe collar towards the left-shoe forefoot portion and gradually towards the lateral side of the left-shoe upper. The right shoe may have a right-shoe upper, which includes a lateral side and a medial side. The right-shoe upper may include a right-shoe collar, a right-shoe forefoot portion, and a right-shoe throat extending from the right-shoe collar towards the right-shoe forefoot portion and gradually towards the medial side of the right-shoe upper.

The pair of shoes may also include a left-shoe midline reference plane that generally bisects the left-shoe upper into the lateral side and the medial side. The pair of shoes may also include a left-shoe-throat midline reference plane that generally bisects the left-shoe throat, such that a throat medial edge is positioned on the medial side of the left-shoe-throat midline reference plane and a throat lateral edge is positioned on the lateral side of the left-shoe-throat midline reference plane. The left-shoe-throat midline reference plane may intersect the left-shoe midline reference plane at a first angle.

In some aspects, a transition of the throat medial edge to the left-shoe collar is positioned on the medial side of the left-shoe midline reference plane. In other aspects, a transition of the throat medial edge to the left-shoe collar is positioned on the lateral side of the left-shoe midline reference plane. The throat lateral edge and the throat medial edge may gradually taper towards one another as the left-shoe throat extends towards the left-shoe forefoot portion.

The pair of shoes may also include a right-shoe midline reference plane that generally bisects the right-shoe upper into the lateral side and the medial side. The pair of shoes may also include a right-shoe-throat midline reference plane that generally bisects the right-shoe throat, such that a throat medial edge is positioned on the medial side of the right-shoe-throat midline reference plane and a throat lateral edge is positioned on the lateral side of the right-shoe-throat midline reference plane. The right-shoe-throat midline reference plane may intersect the right-shoe midline reference plane at a second angle. The first angle may be less than, equal to or greater than the second angle.

In some aspects, a transition of the throat medial edge to the right-shoe collar is positioned on the medial side of the right-shoe midline reference plane. In other aspects, a transition of the throat medial edge to the right-shoe collar is positioned on the lateral side of the right-shoe midline reference plane. The throat lateral edge and the throat medial edge may gradually taper towards one another as the right-shoe throat extends towards the right-shoe forefoot portion.

The left shoe may further include a left-shoe heel counter having a lateral heel-counter portion and medial heel-counter portion. The medial heel-counter portion of the left shoe may be larger than the lateral heel-counter portion of the left shoe. The right shoe may further include a right-shoe heel counter having a lateral heel-counter portion and a medial heel-counter portion. The lateral heel-counter portion of the right shoe may be larger than the medial heel-counter portion of the right shoe.

Yet another aspect disclosed herein is directed to a pair of shoes having a left shoe and a right shoe. The left shoe may have a left-shoe upper, which includes a lateral side, a medial side, a heel portion, a midfoot portion, and a forefoot portion. The left-shoe upper may include a left-shoe heel counter that is constructed into the heel portion of the left-shoe upper and that includes a lateral heel-counter portion providing a first amount of support on the lateral side of the left-shoe upper and a medial heel-counter portion providing a second amount of support on the medial side of the left-shoe upper. The second amount of support may be greater than the first amount of support. The right shoe may have a right-shoe upper, which includes a lateral side, a medial side, a heel portion, a midfoot portion, and a forefoot portion. The right-shoe upper may include a right-shoe heel counter that is constructed into the heel portion of the right-shoe upper and that includes a lateral heel-counter portion providing a third amount of support on the lateral side of the right-shoe upper and a medial heel-counter portion providing a fourth amount of support on the medial side of the right-shoe upper. The third amount of support may be greater than the fourth amount of support.

The medial heel-counter portion of the left-shoe upper may be larger than the lateral heel-counter portion of the left-shoe upper. The lateral heel-counter portion of the right-shoe upper may be larger than the medial heel-counter portion of the right-shoe upper.

The medial heel-counter portion of the left-shoe upper may include a first leading edge oriented towards the forefoot portion of the left-shoe upper. The lateral heel-counter portion of the left-shoe upper may include a second leading edge oriented towards the forefoot portion of the left-shoe upper. The first leading edge may be closer to the forefoot portion than the second leading edge.

The medial heel-counter portion of the right-shoe upper may include a third leading edge oriented towards the forefoot portion of the right-shoe upper. The lateral heel-counter portion of the right-shoe upper may include a fourth leading edge oriented towards the forefoot portion of the right-shoe upper. The fourth leading edge may be closer to the forefoot portion than the third leading edge.

The medial heel-counter portion of the left-shoe upper may be thicker than the lateral heel-counter portion of the left-shoe upper. The lateral heel-counter portion of the right-shoe upper may be thicker than the medial heel-counter portion of the right-shoe upper. The medial heel-counter portion of the left-shoe upper may be less flexible than the lateral heel-counter portion of the left-shoe upper. The lateral heel-counter portion of the right-shoe upper may be less flexible than the medial heel-counter portion of the right-shoe upper.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A pair of shoes comprising:

a left shoe having a left-shoe upper with a left-shoe collar, a left-shoe forefoot portion, and a left-shoe throat extending from the left-shoe collar towards the left-shoe forefoot portion, wherein a left-shoe-throat midline reference plane bisecting the left-shoe throat disproportionately divides the left-shoe upper into a medial-side portion that is larger than a lateral-side portion the medial-side portion of the left shoe extending from a left-shoe throat medial edge to a left-shoe biteline, the lateral-side portion of the left shoe extending from a left-shoe-throat lateral edge to the left-shoe biteline; and a right shoe having a right-shoe upper with a right-shoe collar, a right-shoe forefoot portion, and a right-shoe throat extending from the right-shoe collar towards the right-shoe forefoot portion, wherein a right-shoe-throat midline reference plane bisecting the right-shoe throat disproportionately divides the right-shoe upper into a lateral-side portion that is larger than a medial-side portion, the medial-side portion of the right shoe extending from a right-shoe-throat medial edge to a right-shoe biteline, the lateral-side portion of the right shoe extending from a right-shoe-throat lateral edge to the right-shoe biteline.

2. The pair of shoes of claim 1, wherein the left-shoe throat includes a left-shoe throat base positioned on an end of the left-shoe throat opposite the left-shoe collar, wherein the left-shoe throat base includes a midpoint aligned with the left-shoe-throat midline reference plane, and wherein the midpoint of the left-shoe throat base is offset from a left-shoe midline reference plane towards a lateral side of the left shoe wherein a left-shoe midline reference plane generally bisects the left-shoe upper into the lateral side and a medial side.

3. The pair of shoes of claim 2, wherein the right-shoe throat includes a right-shoe throat base positioned on an end of the right-shoe throat opposite the right-shoe collar, wherein the right-shoe throat base includes a midpoint aligned with the right-shoe-throat midline reference plane, and wherein the midpoint of the right-shoe throat base is offset from a right-shoe midline reference plane towards a medial side of the right shoe wherein a right-shoe midline reference plane generally bisects the right-shoe upper into a lateral side and the medial side.

4. The pair of shoes of claim 3, wherein the midpoint of the right-shoe throat base is offset by a first amount and the midpoint of the left-shoe throat base is offset by a second amount, and wherein the first amount is greater than the second amount.

5. The pair of shoes of claim 1, wherein the left shoe further comprises a left-shoe heel counter having a lateral heel-counter portion and a medial heel-counter portion, the medial heel-counter portion of the left shoe being larger than the lateral heel-counter portion of the left shoe, and wherein the right shoe further comprises a right-shoe heel counter having a lateral heel-counter portion and a medial heel-counter portion, the lateral heel-counter portion of the right shoe being larger than the medial heel-counter portion of the right shoe.

6. A pair of shoes comprising:

a left shoe having a left-shoe upper, which includes a lateral side and a medial side, wherein the left-shoe upper includes a left-shoe collar, a left-shoe forefoot portion, and a left-shoe throat extending from the left-shoe collar towards the left-shoe forefoot portion and including a left-shoe-throat medial edge, a left-shoe-throat lateral edge, and a left-shoe-throat base extending between and connecting the left-shoe-throat medial edge and the left-shoe-throat lateral edge, wherein a left-shoe midline reference plane generally bisects the left-shoe upper into the lateral side and the medial side, and wherein a midpoint of the left-shoe-throat base is offset towards the lateral side of the left-shoe upper; and a right shoe having a right-shoe upper, which includes a lateral side and a medial side, wherein the right-shoe upper includes a right-shoe collar, a right-shoe forefoot portion, and a right-shoe throat extending from the right-shoe collar towards the right-shoe forefoot portion and including a right-shoe-throat medial edge, a right-shoe-throat lateral edge, and a right-shoe-throat base extending between and connecting the right-shoe-throat medial edge and the right-shoe-throat lateral edge, wherein a right-shoe midline reference plane generally bisects the right-shoe upper into the lateral side and the medial side, and wherein a midpoint of the right-shoe-throat base is offset towards the medial side of the right-shoe upper wherein a transition of the right-shoe-throat lateral edge to the right-shoe collar is positioned on the medial side of the right-shoe upper.

7. The pair of shoes of claim 6 further comprising, a left-shoe-throat midline reference plane that passes through the midpoint of the left-shoe-throat base and generally bisects the left-shoe throat, wherein the left-shoe-throat midline reference plane intersects the left-shoe midline reference plane at a first angle.

8. The pair of shoes of claim 7, wherein a transition of the left-shoe-throat medial edge to the left-shoe collar is positioned on the medial side of the left-shoe upper.

9. The pair of shoes of claim 7, wherein a transition of the left-shoe-throat medial edge to the left-shoe collar is positioned on the lateral side of the left-shoe upper.

10. The pair of shoes of claim 7, wherein the left-shoe-throat lateral edge and the left-shoe-throat medial edge gradually taper towards one another as the left-shoe throat extends towards the left-shoe forefoot portion.

11. The pair of shoes of claim 7 further comprising, a right-shoe-throat midline reference plane that passes through the midpoint of the right-shoe-throat base and generally bisects the right-shoe throat, wherein the right-shoe-throat midline reference plane intersects the right-shoe midline reference plane at a second angle.

12. The pair of shoes of claim 11, wherein the first angle is less than the second angle.

13. The pair of shoes of claim 11, wherein the right-shoe-throat lateral edge and the right-shoe-throat medial edge gradually taper towards one another as the right-shoe throat extends towards the right-shoe forefoot portion.

14. The pair of shoes of claim 6, wherein the left shoe further comprises a left-shoe heel counter having a lateral heel-counter portion and medial heel-counter portion, the medial heel-counter portion of the left shoe being larger than the lateral heel-counter portion of the left shoe, and wherein the right shoe further comprises a right-shoe heel counter having a lateral heel-counter portion and a medial heel-counter portion, the lateral heel-counter portion of the right shoe being larger than the medial heel-counter portion of the right shoe.

15. A pair of shoes comprising:

a left shoe having a left-shoe upper, which includes a lateral side, a medial side, a heel portion, a midfoot portion, and a forefoot portion, wherein the left-shoe upper includes a left-shoe heel counter that is constructed into the heel portion of the left-shoe upper and that includes a lateral heel-counter portion providing a first amount of support on the lateral side of the left-shoe upper and a medial heel-counter portion providing a second amount of support on the medial side of the left-shoe upper, and wherein the second amount of support is greater than the first amount of support; and a right shoe having a right-shoe upper, which includes a lateral side, a medial side, a heel portion, a midfoot portion, and a forefoot portion, wherein the right-shoe upper includes a right-shoe heel counter that is constructed into the heel portion of the right-shoe upper and that includes a lateral heel-counter portion providing a third amount of support on the lateral side of the right-shoe upper and a medial heel-counter portion providing a fourth amount of support on the medial side of the right-shoe upper, and wherein the third amount of support is greater than the fourth amount of support.

16. The pair of shoes of claim 15, wherein the medial heel-counter portion of the left-shoe upper is larger than the lateral heel-counter portion of the left-shoe upper, and wherein the lateral heel-counter portion of the right-shoe upper is larger than the medial heel-counter portion of the right-shoe upper.

17. The pair of shoes of claim 16, wherein the medial heel-counter portion of the left-shoe upper includes a first leading edge oriented towards the forefoot portion of the left-shoe upper, the lateral heel-counter portion of the left-shoe upper includes a second leading edge oriented towards the forefoot portion of the left-shoe upper, and the first leading edge is closer to the forefoot portion than the second leading edge, and wherein the medial heel-counter portion of the right-shoe upper includes a third leading edge oriented towards the forefoot portion of the right-shoe upper, the lateral heel-counter portion of the right-shoe upper includes a fourth leading edge oriented towards the forefoot portion of the right-shoe upper, and the fourth leading edge is closer to the forefoot portion than the third leading edge.

18. The pair of shoes of claim 15, wherein the medial heel-counter portion of the left-shoe upper is thicker than the lateral heel-counter portion of the left-shoe upper, and wherein the lateral heel-counter portion of the right-shoe upper is thicker than the medial heel-counter portion of the right-shoe upper.

* * * * *